US005740643A

United States Patent [19]

Huntley

[11] Patent Number: 5,740,643

[45] Date of Patent: Apr. 21, 1998

[54] FIREPROOF BUILDING

[76] Inventor: Henry Huntley, 1838 Leisure La., Meridian, Id. 83642

[21] Appl. No.: 519,411

[22] Filed: Aug. 24, 1995

[51] Int. Cl.[6] ..... E04B 1/94

[52] U.S. Cl. ..... 52/265; 52/295; 52/309.12; 52/344

[58] Field of Search ..... 52/265, 269, 260, 52/262, 439, 295, 293.1, 293.2, 293.3, 454, 444, 309.12, 405.3, 405.1, 344, 342, 309.9, 309.14, 309.17

[56] References Cited

U.S. PATENT DOCUMENTS

| | | | |
|---|---|---|---|
| 1,293,377 | 2/1919 | Donaldson | 52/344 |
| 1,925,103 | 9/1933 | Loftus et al. | 52/405.1 X |
| 2,213,603 | 9/1940 | Young et al. | 52/344 |
| 2,649,625 | 8/1953 | Johnson | 52/293.1 X |
| 3,216,163 | 11/1965 | Carew | 52/293.1 X |
| 4,028,854 | 6/1977 | Diggs | 52/93.1 |
| 4,090,336 | 5/1978 | Carroll | 52/309.12 X |
| 4,193,240 | 3/1980 | Odoerfer | 52/344 |
| 4,324,080 | 4/1982 | Mullins | 52/405.3 X |
| 4,348,845 | 9/1982 | Iannarelli | 52/405 |
| 4,841,705 | 6/1989 | Fuhrer | 52/344 X |
| 5,167,098 | 12/1992 | Blackwelder | 52/90 |
| 5,359,816 | 11/1994 | Iacouides | 52/265 X |
| 5,367,845 | 11/1994 | Hartling | 52/293.1 |

*Primary Examiner*—Carl D. Friedman
*Assistant Examiner*—Timothy B. Kang
*Attorney, Agent, or Firm*—Ken J. Pedersen; Barbara S. Pedersen

[57] ABSTRACT

The present invention is a fireproof and hurricane proof building having a concrete floor, a plurality of special wall assemblies, and a special roof assembly. Each special wall assembly comprises a reinforced cinder block wall, foam, stucco, fireproof coatings, steel studs, and fire retardant gypsum plaster. The special roof assembly comprises steel trusses, steel joists, metal sheets, and fireproof tiles. The windows and doors are fireproof and hurricane proof. The special wall assemblies, special roof assembly, and concrete floor are interconnected to form an air tight, fireproof and hurricane proof enclosure.

5 Claims, 6 Drawing Sheets

FIREPROOF BUILDING

BACKGROUND OF THE INVENTION

1. Field of Invention

The present invention relates to a fireproof and hurricane proof building comprising a concrete floor, a plurality of special wall assemblies, and a special roof assembly.

2. Description of Prior Art

U.S. Pat. No. 4,028,854 (Diggs) discloses a fireproof modular building having a frame comprising prefabricated non-flammable tubular wall columns and roof beams adapted for circulating a non-flammable fluid and a means for circulating the non-flammable fluid. Diggs also discloses load bearing column and roof plates made to cooperate with the tubular wall columns and roof beams. The column and roof plates have internal flow passages for circulating the non-flammable fluid and so that a complete flow path can be formed. Diggs also comprises a plurality of rigid, fireproof, pre-fabricated insulated panels attached to the columns and beams to form the building's wall and roof structure.

U.S. Pat. No. 5,167,098 (Blackwelder) discloses a fire resistant modular building comprising a support platform, corner-wall columns, roof beams, pitch panels, and partitions. The partitions form the walls and ceiling and comprise stacked sheets of gypsum type board and overlapping metal sheets.

SUMMARY OF THE INVENTION

The present invention is a fireproof and hurricane proof building having a concrete floor, a plurality of special wall assemblies, and a special roof assembly. Each special wall assembly comprises a reinforced cinder block wall with foam and stucco on the outside of the cinder block, and metal lath and fire retardant gypsum plaster on the inside. The special roof assembly comprises steel trusses, steel joists, metal roof sheets, and fireproof tiles. The windows and doors are fireproof and hurricane proof. The special wall assemblies, special roof assembly, and concrete floor are interconnected to form an air tight, fireproof and hurricane proof enclosure.

DESCRIPTION OF THE PREFERRED EMBODIMENT

Figure 1:
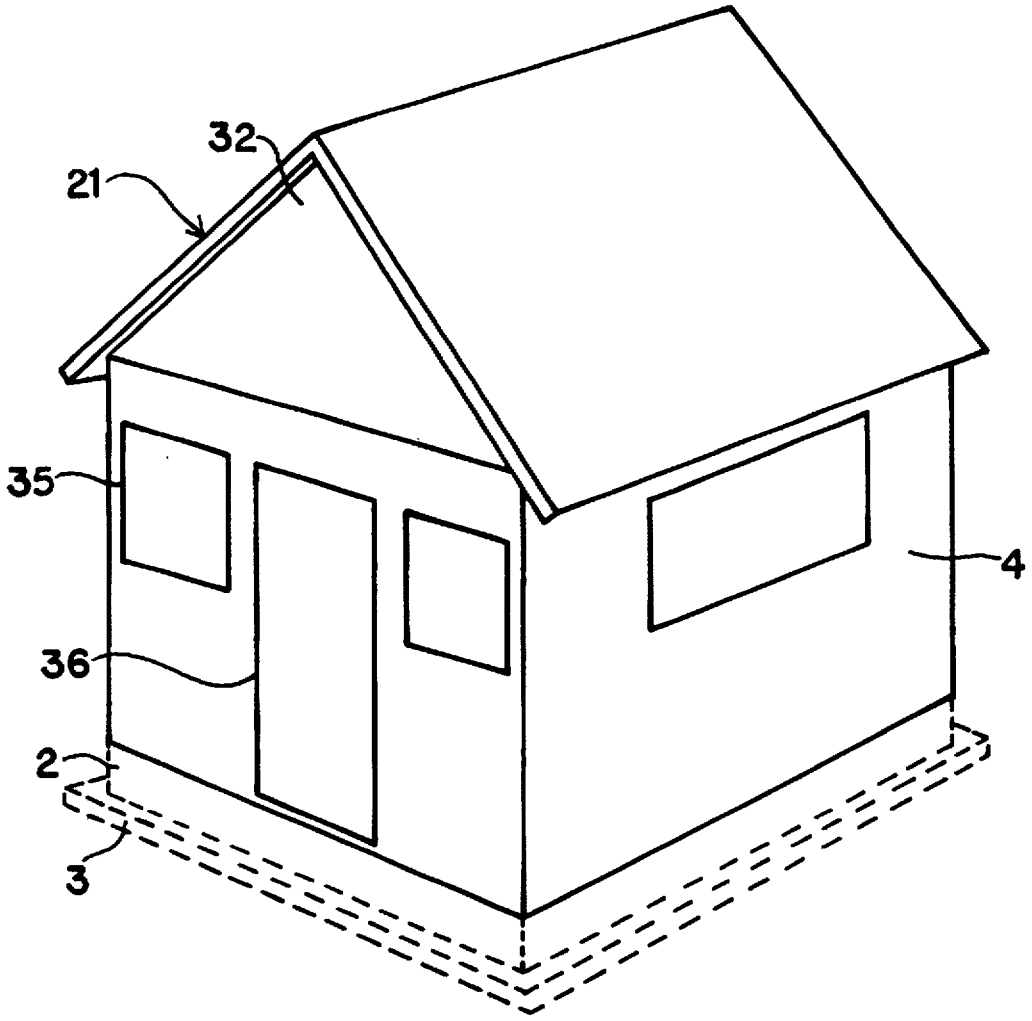
FIG. 1 is a perspective front view of the fireproof and hurricane proof building.

The present invention is a fireproof and hurricane proof building 1 having a concrete slab floor 2. (See FIGS. 1 & 2) A concrete foundation 3 is integral with the concrete floor 2 and extends downwardly from the concrete floor 2.

The building's vertical walls are formed by a plurality of special wall assemblies 4, each of which, generally speaking, comprises a reinforced cinder block wall 5 with foam 6, stucco mesh 17, and stucco 7 on the outside of the cinder block. On the inside of the cinder block wall 5 is metal lath 11 and fire retardant plaster 8. The special wall assemblies 4 define the perimeter of the fireproof and hurricane proof building 1 and have an overall preferred thickness of approximately 13 inches.

Figure 2:
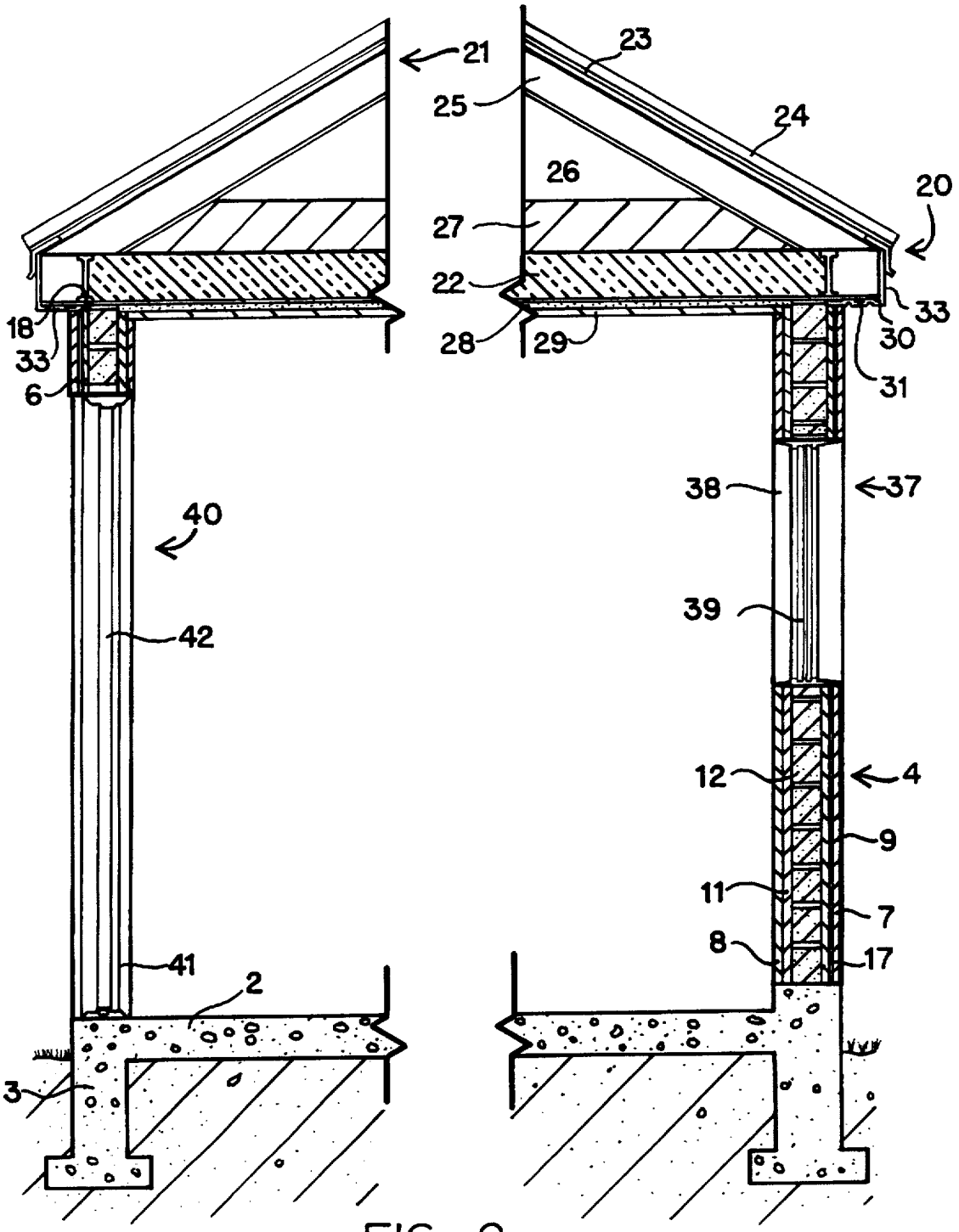
FIG. 2 is a partial cross-sectional view of the fireproof and hurricane proof building including the special wall assemblies, concrete floor, and the roof assembly.
Figure 3:
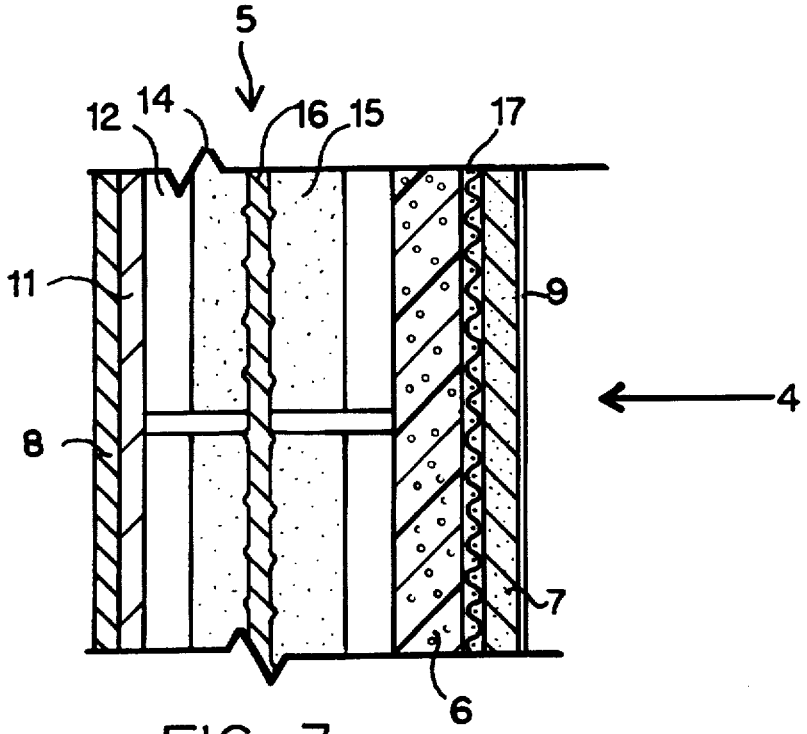
FIG. 3 is a partial side cross-sectional view of a special wall assembly.

More specifically, as shown in FIGS. 2 and 3, a special wall assembly 4 comprises an elongated vertical wall formed by conventional cinder blocks 12 having at least one central aperture 13. The cinder blocks 12 are attached to each other with mortar, or other conventional building cement, and form a generally smooth wall. The cinder blocks 12 are stacked in such a way that the central apertures 13 of the interconnected vertical columns of cinder blocks 12 form a vertical space 14. The vertical spaces 14 formed by the aligned central apertures 13 are filled with concrete 15. Disposed in each vertical space 14 and surrounded by the concrete 15 is at least one elongated reinforcing steel rod (re-bar) member 16.

Figure 4:
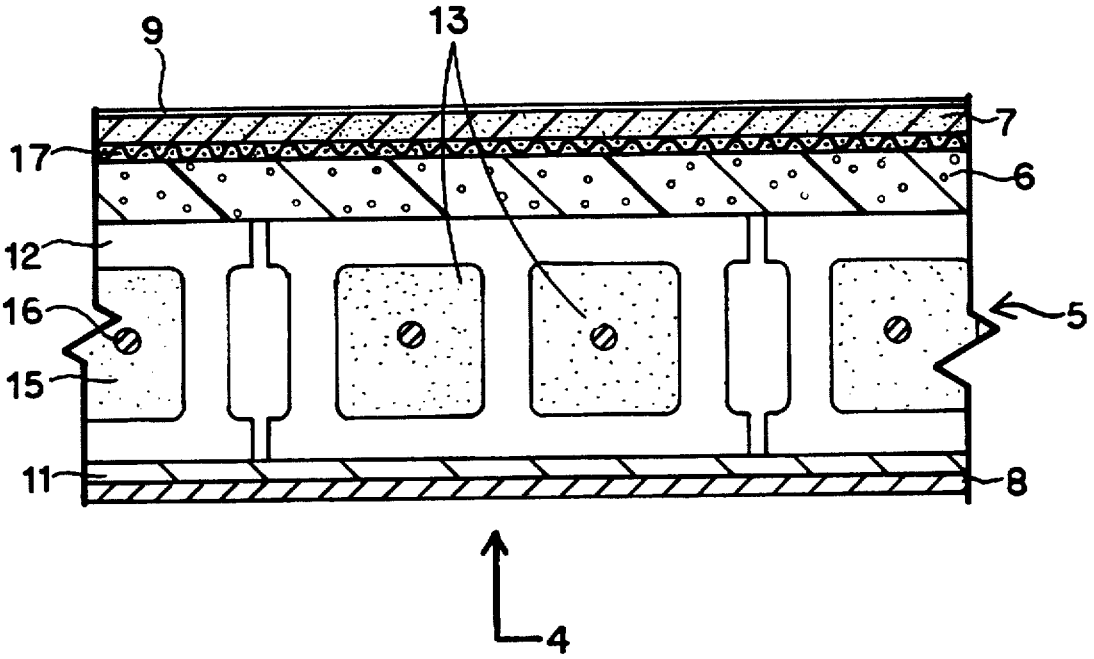
FIG. 4 is a partial top cross-sectional view of a special wall assembly

The outside face of the reinforced cinder block wall 5 is covered with two inches of foam 6. Preferably, two pieces of one inch foam 6 may be laminated to obtain the two inch thickness. When laminated, the two foam pieces overlap to eliminate any seam extending all the way through the foam 6. The foam 6 is covered by a stucco mesh 17 that is attached to the foam 6 and the outside face of the reinforced cinder block wall 5 using conventional fasteners such as 2.5 inch screws. Stucco 7, having a preferred thickness of ¾ of an inch, covers the mesh 17 and comprises a conventional scratch coat and a conventional brown coat. A fireproof coating 9, being conventional final finish coat, is applied over the stucco 7. In a preferred embodiment, the thickness of the fireproof coating 9 is ⅛ of an inch, and the combination stucco/coating has a minimum 4 hour fire rating. The fireproof coating 9 forms the outside surface of the special wall assemblies 4. (See FIGS. 3 & 4)

Metal, preferably, galvanized steel, lath 11 covers the cinder block walls and is attached by conventional fasteners. For example, in the present invention galvanized steel lath 11 is connected to the cinder block walls 5 using screws. The lath 11 is covered with fire retardant gypsum plaster 8 to achieve a minimum 4 hour fire rating. The preferred thickness of the fire retardant plaster 8 is ¾ of an inch, but again, it is the fire rating, rather than the thickness that is important. The fire retardant plaster 8 forms the inside surface of the special wall assembly 4. (See FIGS. 3 & 4)

Figure 5:
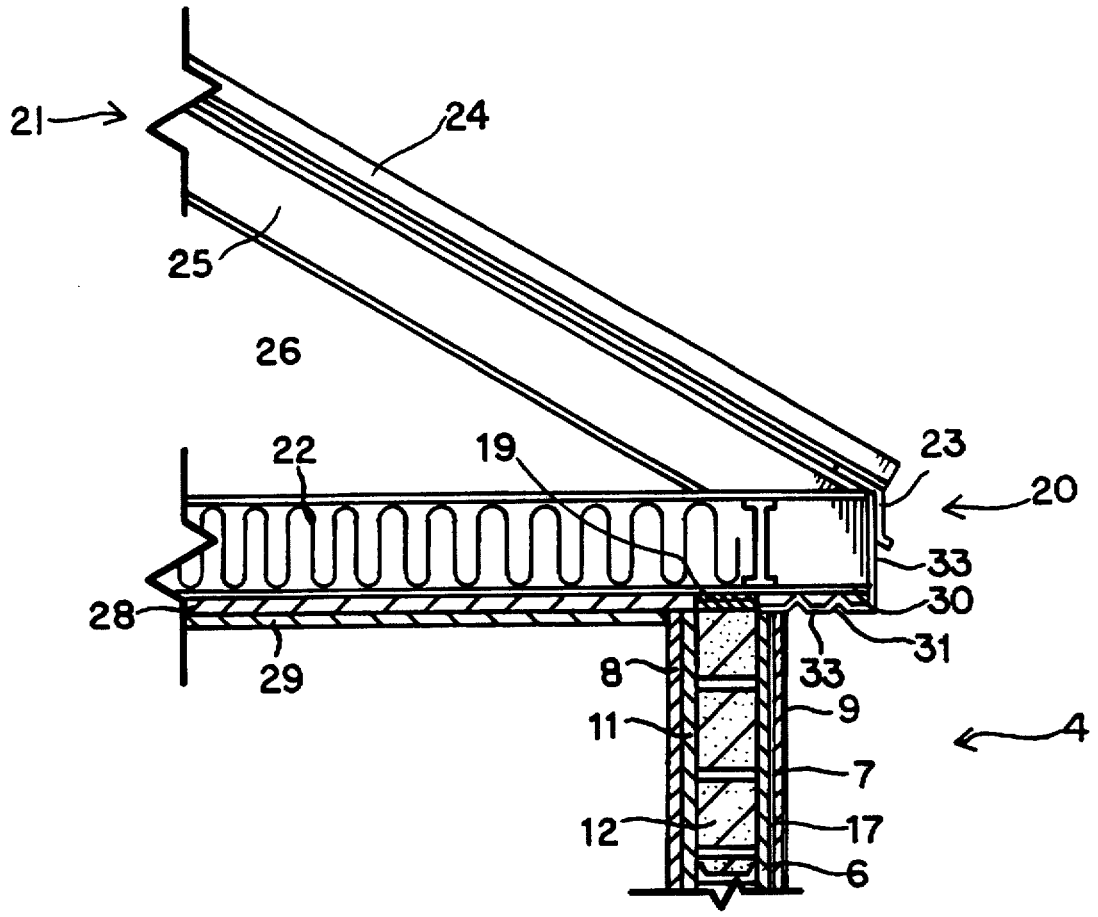
FIG. 5 is a side cross-sectional view of the wall-roof assembly.

Referring to FIGS. 2 & 5, each special wall assembly 4 has a top and a bottom end. Attached to the top end of the special wall assembly 4 is a roof assembly mounting means 18. In the preferred embodiment, the roof assembly mounting means 18 comprises an elongated metal plate 19 mounted on the top end of the special wall assembly 4 by conventional fastening methods. The width of the metal plate 19 must be sufficient for the roof assembly 20 to be attached to the special wall assembly 4 by conventional methods, for example, by welding. In the disclosed invention, a 4 inch metal plate 19 was used for welding the roof assembly 20 to the top end of the special wall assembly 4, but the width of the metal plate 19 is not critical.

The roof assembly 20 generally comprises a roof frame 21, steel trusses 22, metal roof sheets 23, and fireproof tiles 24. The steel trusses 22 have a top edge and a bottom edge. The bottom edge of the steel trusses 22 are attached to the roof assembly mounting means 18 and extend horizontally over the concrete floor 2 and beyond the special wall assembly 4. The roof frame 21 is formed by steel joists 25 and is attached to the top edge of the steel trusses 22 by conventional methods, for example, by welding. The preferred roof shape is an elevated, angular roof frame 21. Metal roof sheets 23 are mounted on the roof frame 21 by conventional methods. Fireproof tiles 24 are connected to the metal sheets 23 and form the outside surface of the roof assembly 20. The preferred embodiment has fireproof tiles 24, however, a metal roof is also acceptable.

The roof frame 21 and the steel trusses 22 define a ceiling space 26 that is insulated with fire retarding insulation 27 to achieve a 4 hour rating. In the preferred embodiment, 8 inches of insulation 27 is used. Steel lath 28 is mounted to the bottom edge of the horizontal steel trusses 22 by conventional fastening methods. Fire retardant gypsum plaster 29 covers the steel lath 28 and forms the inside ceiling.

Referring to FIG. 5, a wall-roof assembly occurs at the intersection of the roof assembly 20 and special wall assembly 4. The roof assembly 20 extends beyond the special wall assembly 4 and forms soffits 30. In this assembly, the soffits 30 are covered with galvanized rib metal lath 31 which is attached to the bottom side of the steel joist roof frame 21 by conventional fasteners such as screws. When the preferred angled roof assembly 20 is used on the fireproof and hurricane proof building, gables 32 are present under the pitched roof line. The gables 32 are also covered with galvanized rib metal lath 31 by attaching the lath 31 to the roof frame 21. The metal lath 31 on both the soffits 30 and gables 32 is covered with ⅞ of an inch of stucco 33 up to the roof line, however, the thickness of the stucco 33 is not a critical dimension.

Figure 6:
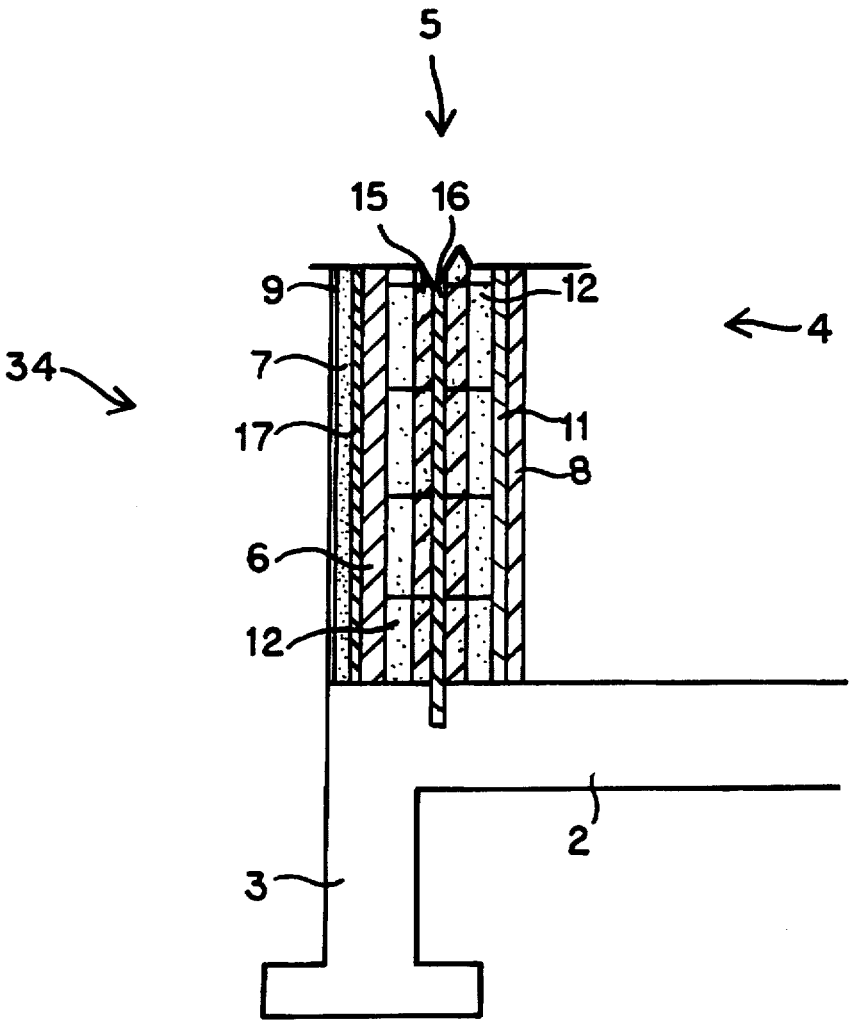
FIG. 6 is a side cross-sectional view of the wall-floor assembly.

As shown in FIG. 6, a wall-floor assembly 34 occurs where the special wall assembly 4 and the concrete floor 2 intersect. The bottom end of the special wall assembly 4 is connected to the concrete floor 2 by an attaching means. In the preferred embodiment, the attaching means comprises a plurality of re-bar members 16 disposed in the vertical spaces 14 formed by the aligned cinder block apertures 13 within the cinder block wall 5 extending into and fixedly connected to the concrete floor 2 and are fixedly embedded in the concrete floor 2.

Referring to FIGS. 1 & 2, each special wall assembly 4 may have a plurality of window apertures 35 and at least one door aperture 36. Window assemblies 37 are disposed in the window apertures 35 in the special wall assembly 4 and comprise a metal window frame 38 and a double paned window 39. The door assembly 40 is mounted within the door aperture 36 and comprises a metal door jam 41 and a metal door 42. The metal door 42 is pivotally attached to the metal door jam 41. (See FIG. 2.)

Both the door assembly 40 and the window assemblies, 37 are air tight. In addition, the special roof assembly 20, the special wall assemblies 4, and concrete floor 2 form an air tight, fireproof and hurricane proof enclosure.

Figure 7:
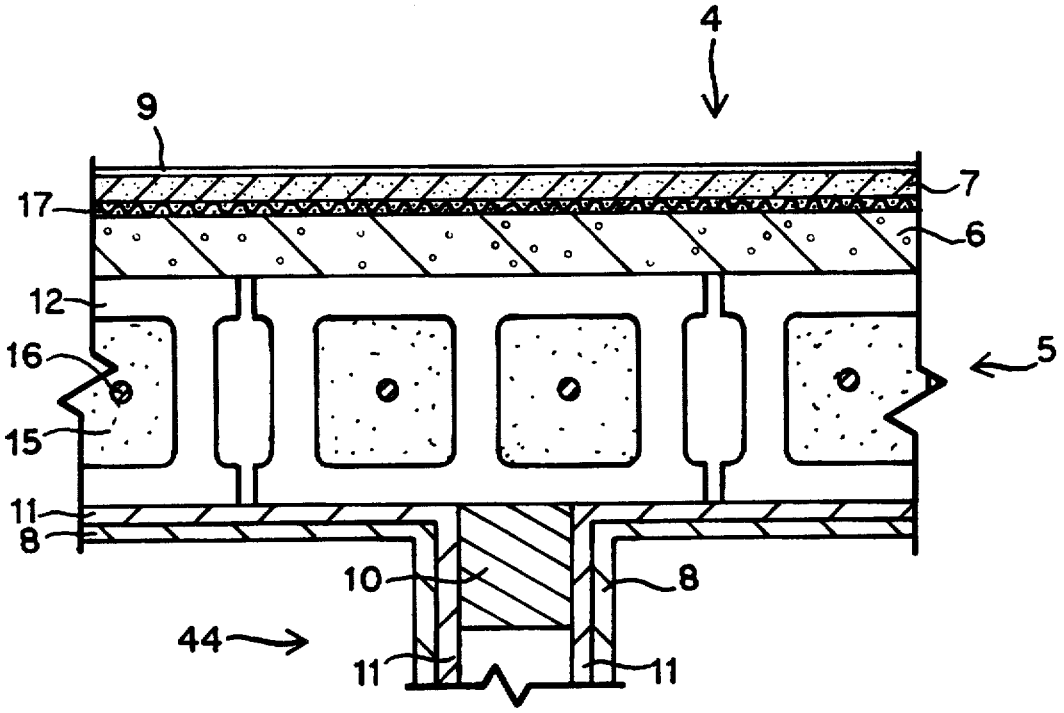
FIG. 7 is a partial top cross-sectional view of an intersection of a special wall assembly and an interior wall.

Referring to FIG. 7, when interior walls 44 are desired, elongated vertical steel studs 10 are attached to the inside face of the cinder block wall 5 by conventional fasteners. The interior walls 44 comprise steel studs 10, metal lath 11, and fire retardant plaster 8. The steel studs 10 have a top end and a bottom end. The steel studs 10 have a first and second face. Attached to both sides of the vertical steel studs 10 are metal lath. Fire retardant plaster covers both the lath. The steel studs 10 are attached to the concrete floor 2 by a fastening means.

The preferred fastening means for fastening the steel studs 10 to the concrete floor 2 comprises a J bolt. The hook shaped portion of the J bolt is fixedly embedded in the concrete floor 2. The straight portion of the J bolt is fixedly connected to the bottom end of the steel stud 10 by conventional means, such as welding.

The disclosed invention avoids the problems associated with the prior art because it is low maintenance. Diggs utilizes a circulating fire-retardant liquid within the roof and walls which requires maintaining a circulating means as well as doing maintenance to avoid and detect leaks in the fluid system. The current invention requires no additional maintenance to insure the building remains fireproof and hurricane proof.

The current invention is more energy efficient than Blackwelder because of the use of insulation in the attic space and the foam in the special wall assemblies. In addition, the present invention, particularly the windows and door assemblies, are air tight, which increases the energy efficiency over both Diggs and Blackwelder.

Another advantage of this invention is that in addition to being fireproof, it is also hurricane proof. None of the prior art envisions the building being a hurricane proof as well as a fireproof structure.

Although this invention has been described above with reference to particular means, materials and embodiments, it is to be understood that the invention is not limited to these disclosed particulars, but extends instead to all equivalents within the scope of the following claims.

What is claimed is:

1. A fireproof and hurricane proof building comprising:

a. a concrete floor, said floor having a downwardly extending concrete foundation integral with said floor;

b. an upwardly extending wall assembly having a top end and a bottom end, said bottom end being fixedly connected to said concrete floor, said wall assembly further comprising:

(1) a reinforced cinder block wall having an inside face and an outside face;

(2) foam faced with mesh, the foam and mesh fixedly connected to said outside face of said block wall:

(3) stucco fixedly attached to said mesh;

(4) a fireproof coating attached to said stucco:

(5) a first metal lath attached to said inside face of said block wall; and (6) fire retardant plaster connected to said first metal lath:

c. a roof assembly attached to said top end of said wall assembly;

d. an interior wall comprising:

(1) a plurality of elongated steel studs, at least one of said plurality of studs fixedly connected to said inside face of said block wall, said plurality of studs being fixedly connected to and upwardly extending from said concrete floor, each of said studs further having a top stud end and a bottom stud end and a surface;

(2) a second metal lath fixedly attached to said surface of each of said studs; and (3) fire retardant plaster fixedly attached to said second lath.

2. The fireproof and hurricane proof building of claim 1 wherein said block wall forms an airtight joint to said floor.

3. The fireproof and hurricane proof building of claim 1 wherein said roof assembly forms an airtight joint to said block wall.

4. The fireproof and hurricane proof building of claim 1 wherein said roof assembly comprises a metal truss.

5. A building comprising:

a. a foundation comprising concrete, said foundation providing an integral floor;

b. a vertical exterior wall having a bottom surface and a top surface, said bottom surface fixed to said foundation, said exterior wall comprising:

(1) a rod fixed in said foundation and extending vertically therefrom;

(2) a first block having a first aperture, said rod extending through said first aperture;

(3) a second block having a second aperture, said rod extending through said second aperture, said first and second aperture defining a vertical space, said vertical space comprising concrete that fixes said rod therewithin, said first and second block defining an interior surface and an exterior surface of said exterior wall;

(4) a first foam sheet having a first perimeter, said first foam sheet fixed to said exterior surface;

(5) a second foam sheet having a second perimeter, said second foam sheet laminated in overlapped relation to said first foam sheet wherein said second perimeter is non-coextensive on said first perimeter;

(6) a mesh fixed to said first block;

(7) stucco covering said mesh;

(8) a fireproof coating covering said stucco;

(9) a first metal lath fixed to said interior surface; and

(10) a metal plate fixed to said top surface; and c. a roof comprising:

(1) a truss welded to said plate, said truss extending beyond said plate to define a soffit;

(2) a metal joist welded to said truss and extending above said truss;

(3) a metal sheet fixed to said joist at a position above said joist;

(4) a fireproof tile fixed to said metal sheet at a position above said metal sheet;

(5) a second metal lath welded to said truss at a position below said truss; and d. a fire-retardant covering comprising plaster that covers said first metal lath and said second metal lath.

* * * * *